United States Patent [19]

McCollum

[11] Patent Number: 4,732,390

[45] Date of Patent: Mar. 22, 1988

[54] GOLF CLUB SWING TRAINING DEVICE

[76] Inventor: Thomas H. McCollum, 5608 Spring Flat Rd., Albany, Ga. 31705

[21] Appl. No.: 929,760

[22] Filed: Nov. 12, 1986

[51] Int. Cl.[4] ..... A63B 69/36

[52] U.S. Cl. ..... 273/186 R; 273/200 B

[58] Field of Search ..... 273/186 R, 163 A, 186 A, 273/186 B, 186 C, 183 A, DIG. 30, 200, 200 B, 196

[56] References Cited

U.S. PATENT DOCUMENTS

| | | | |
|---|---|---|---|
| 3,273,893 | 9/1966 | Duncan | 273/163 A |
| 3,554,555 | 1/1971 | Macri | 273/186 R |
| 3,741,550 | 6/1973 | Landures | 273/186 R |

*Primary Examiner*—George J. Marlo

*Attorney, Agent, or Firm*—Harry I. Leon

[57] ABSTRACT

An apparatus for allowing a golfer to practice his club swings indoors or out. The apparatus is equipped with mechanical indicating devices that tell a golfer at a glance if his swing was correct. These indicators, which are held in place by magnets on a steel plate and have means for threadedly adjusting their overall height, can be precisely positioned to take into account variations between different golfers and between different driving clubs or putting irons. The tops of the indicators are formed of a highly springy, resilient material which vibrates for an extended period of time after being hit or even brushed by a club. A good swing can be easily recognized as one after which none of these fault-finding indicators are moving.

5 Claims, 7 Drawing Figures

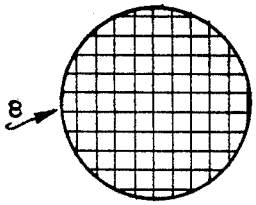
FIG. 2
FIG. 1
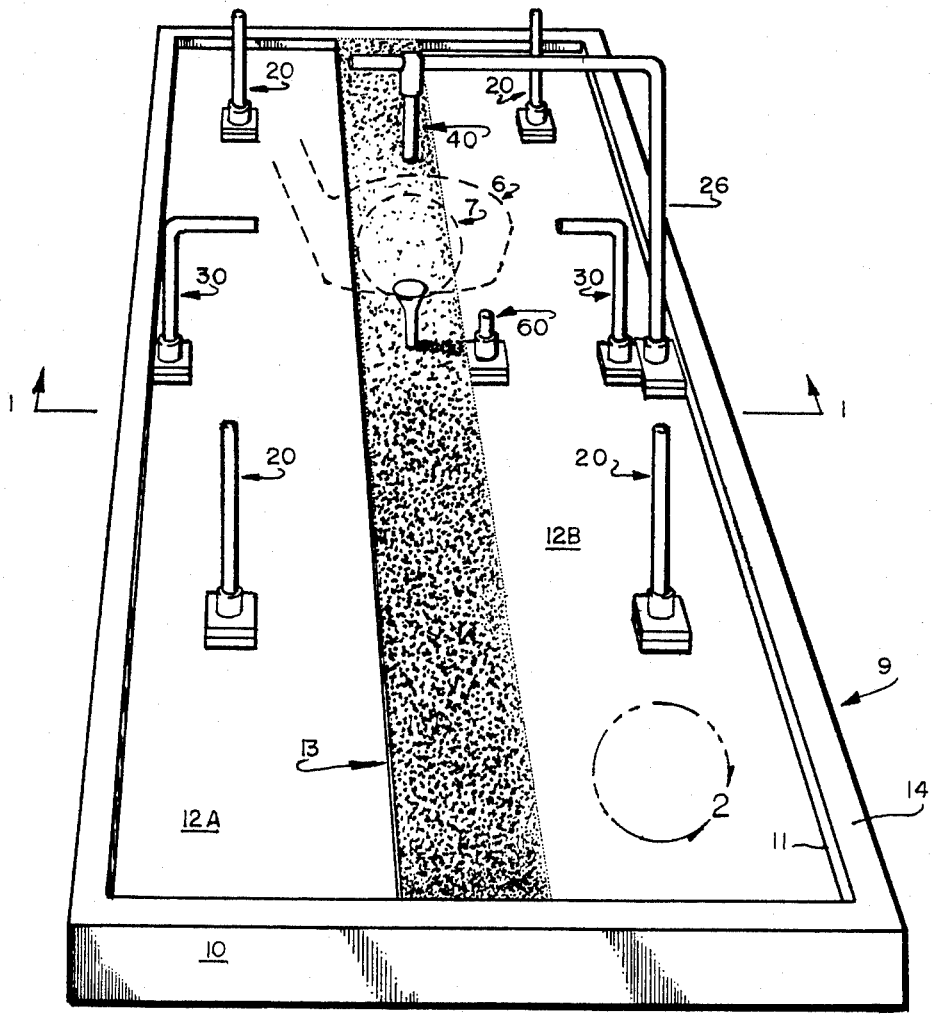

GOLF CLUB SWING TRAINING DEVICE

BACKGROUND OF THE INVENTION

1. Field of the invention

This invention relates to a mechanical means for improving one's skill in the game of golf, said means including an apparatus having either a tee or a simulated turf on which a golf ball is placed and on which vibratory indicators are positioned in relation to the holding stance of a user, the indicators being so placed that they outline the path, before contact with the ball and during the follow through, that a correct swing would take.

2. Description of the Prior Art

Devices to aid in the correction of a faulty golf club swing seem to be nearly as old as the game itself. For example, Olifford, U.S. Pat. No. 720,406, patented Feb. 10, 1903, discloses a device in which the swing approach and follow-through can be monitored.

An early device which used flexible indicators to help mark the path of a club head as it approached the ball was taught by Borthwick, in U.S. Pat. No. 1,532,984, patented Apr. 7, 1925. There Borthwick disclosed a device in which the swing approach and club contact point may be monitored. Borthwick realized that the vibration of indicators showing that the club head has veered off course gives a good indication of a swing that needs correction.

Another who taught the use of vibratory indicators was Burgoyne, U.S. Pat. No. 1,556,919. Burgoyne's vibratory indicator is a spring-rod bearing combination supported by a wire frame anchored to an elongated member forming the practice pad.

Throughout the prior art, only indicators which were for the most part fixed in position were utilized, with the support structure being attached to a practice pad. None of the previous devices has indicators which are capable of being placed nearly anywhere on the practice pad.

SUMMARY OF THE INVENTION

In accordance with the present invention, there is provided a training device to indicate to a golfer that he needs to make improvements in his swing. The device is equipped with indicators that can be more accurately positioned on it than can the indicators of the prior art, thereby allowing the golfer to fine tune his swing. The device includes a golf swing practice pad which is formed from a rigid material that has two elongated rectangular steel plates recessed beneath the top surface of the pad. The steel plates are marked in a grid pattern so that a given position may be assigned coordinates. Indicating devices having magnetized bases are positioned on the steel plates. The combination of a magnetic base on each indicator and steel plates in the pad allows infinite variation in the position of the indicators. The grid lines on the plates facilitate the placement of the indicators thereon proximate the path of a correct swing of the head of a golf driver or putter.

Each of the indicators comprises a flat plastic base to the bottom of which is attached to a magnetic material and from which a vertical column rises. The column is preferably formed as a single piece with the flat base. The vertical column is hollow on the top and has an internal threaded section for threadedly engaging a vibratory member which extends upwardly from the column. The position of the tip of the vibratory member can be very precisely and readily adjusted by the threaded-couple between the vertical column and the vibratory member, thereby allowing a golfer to fine tune the position of each indicator so that he can perfect his swing. The vibratory member is formed of a flexible, springy material which, if struck, is set into motion. Indeed, even a slight brush of the vibratory member sets it into vibration, giving a visible signal. This springy, flexible material is of such a nature that if struck, even lightly, it is set into a vibration of sufficient amplitude that the player can easily see it.

Above the point at which the golf ball is placed is a cantilevered support structure from which an over-the-ball indicator is hung. This indicator is used to determine whether or not the point of contact of the club on the ball is too high. This over-the-ball indicator has an internally threaded structure into which a vibratory member is fastened in such a way that its length can be adjusted along the threaded section.

A second indicator suspended from the cantilevered support structure is also placed near the ball but below its center to register swings in which the club swing contact point is too low.

The training device further comprises a pair of indicators that are constructed similarly to the ones described hereinabove except in this pair of indicators the vibratory member forms a 90° angle to the vertical center line of the base of each indicator. The pair of indicators are placed on either side of the ball in such a way as to indicate whether the initial contact between the club and the ball is made with the club's "sweet spot" or with too much of the heel or of the toe of the club face.

All the indicators can be moved in the plane of the ball or of the ball placed on a tee. The heights of the indicators can also be so adjusted that they outline the path of a good swing. If the swing has some defect, then one or more of the indicators will be struck and set into vibration.

BRIEF DESCRIPTION OF THE DRAWINGS

FIG. 1 is a perspective view of the device embodying this invention;

FIG. 2 is that portion of FIG. 1 encircled by the broken line 2;

DETAILED DESCRIPTION OF THE ILLLUSTRATED EMBODIMENT

Figure 3:
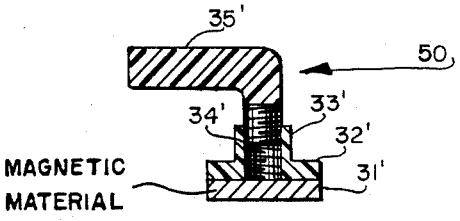
FIG. 3 is the sectional elevation view of the second type of indicator that is used when the ball rests of the artificial grass carpet.

In the specific form illustrated, the golf training device of the invention, which is designated generally by the reference numeral 9, comprises an underlying base including a practice pad 10 molded from a tough, resilient material to provide a cavity 11. Two elongated, thin plates 12*a*, 12*b* formed of a ferromagnetic material such as steel or the like are attached on the bottom of the surface of the cavity 11 by any suitable means and run along the length thereof. The upper surfaces of the plates 12*a*, 12*b* are recessed below the rim 14 of the pad 10. Between the plates, a strip of artificial grass carpet 13 is placed so that its height is approximately the same as that of the rim 14. A grid 8 shown in FIG. 2 is provided on the surfaces of the plates 12*a*, 12*b* so that the position of the indicators which are described hereinbelow may be accurately defined. A typical grid has, by way of example, lines at ⅛ inch spacing.

Figure 4:
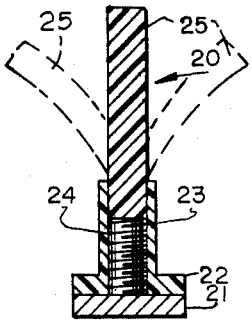
FIG. 4 is a sectional elevation view of the first type of indicator a typical range of motion of the vibratory member as it vibrates being shown in dashed lines.
Figure 5:
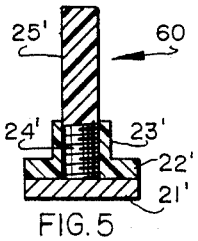
FIG. 5 is a sectional elevation view of the fourth type of indicator.

Basically four types of indicators are used in device 9. The first type is deployed directly beneath the path which the swing of the club 6 should take before and after striking the ball 7. An indicator 20 of this type as is shown on FIGS. 1 and 4 comprises a vibratory member 25 whose longitudinal axis is disposed generally vertically above the practice pad 10.

Figure 7:
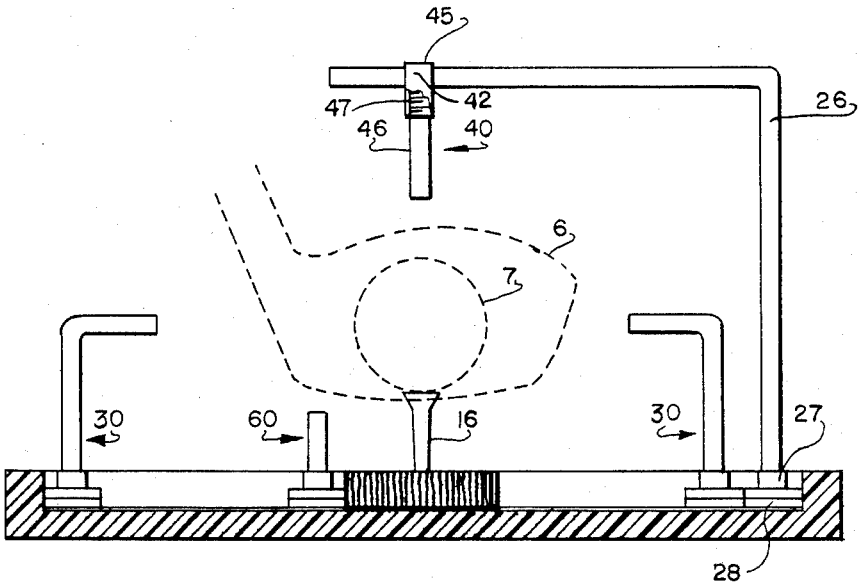
FIG. 7 is a cross-sectional side elevation view showing the device along the line 1—1 of FIG. 1.

The second type of indicator is used to register the lateral motion of the club head at the moment of its contact with the ball 7 when the ball is placed on the tee 16. Two of these indicators are used as shown in FIG. 7. An indicator 30 of the second type is preferably mounted on the practise pad 10 on either side of the ball so that the tip of the vibratory member 35 is disposed in the vertical plane at the leading edge of the ball 7 as it rests on the tee 16. In the indicator 30, the vibratory member 35 has a longitudinal axis which is set generally parallel to the plane of the upper surfaces of the plates 12*a*, 12*b*.

The third type of indicator 40 as shown in FIGS. 1 and 7 is hung above the golf ball 7 and used to detect whether the ball is hit too high. An indicator 40 has a vibratory member 46 which is hung beneath a cantilevered arm 26.

The fourth type of indicator 50 which is shown on FIG. 3 is constructed similarly to the indicators 30 except that the overall height is less. The indicator 50 which is used when the ball is played on the artifical grass carpet is used both to mark the path of a correct swing as do indicators 20 of the first type and to register the lateral motion of the club head 6 as do indicators 30 of the second type.

An indicator 20 of the first type comprises a vibratory member 25, a support structure 22, and means for mounting the support structure on the plates 12*a*, 12*b* utilizing magnetic contact between a magnetic base 21 on the structure 22 and the plates 12*a*, 12*b*. The structure 22 includes a vertical column 23 which has internal threads 24 used both to secure the vibratory member 25 and to allow for precision adjustment of the overall height of the tip of the vibratory member 25. In the preferred embodiment, the top of the vertical column 23 is at generally the same height as the rim 14 when the indicator 20 is mounted on a plate 12*a*, 12*b*.

Figure 6:
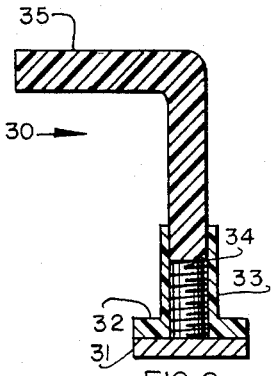
FIG. 6 is a sectional elevation view of the second type of indicator that is used when the ball rests on the tee.

As illustrated in FIGS. 1, 6 and 7, an indicator 30 of the second type is similar in construction to an indicator 20 except for the vibratory member 35. In indicator 30, the longitudinal axis of the member 35 makes a right angle with the longitudinal axis of the support structure 32. The indicator 30 comprises a magnetic base 31 attached to the support structure which includes a vertical column 33. The column 33 has internal threads 34 for securing the vibratory member 35 and to facilitate a precision adjustment of the overall height of the indicator 30. The indicators 30 are used only in line with the leading edge of the ball 7 to register the lateral position of the club head when it strikes the ball.

Indicators 40 of the third type comprise a support structure 42 which includes at least one vibratory member 46 secured to the column by internal threads 47 which allow both for the support of the member 46 and for the precision adjustment of the overall downward extension of the indicator 40. The structure 42 further comprises a ring 45 connected to the column that mounts pivotally around the cantilevered arm 26. The arm 26 is held in position by a mounting bracket 27 with a magnetic base 28 for holding onto either the steel plate 12*a* or 12*b* depending upon whether the user is right or left-handed. In the perferred embodiment the bracket 27 is fastened to the base 28 by any suitable means such as an adhesive, rivets or internal threads for threadedly engaging the arm 26. Alternately, the arm 26 may be formed integrally with the bracket 27. Before use, the height of the tip of the downwardly extending vibratory member 46 is adjusted so that this member is set into vibration if the head of the club is too high when it makes contact with the ball.

A fifth type of indicator 60 is used to register when the club head strike is too low. The indicator 60 is a smaller version of the first type of indicator 20 and is placed close to the front edge of the ball as shown on FIGS. 1 and 7. The elements of the indicator 60 which are referenced by prime numbers resemble the elements of the indicator 20 having the corresponding unprimed numbers.

In practice, when the golf ball 7 is supported on a tee 16 prior to the ball being hit by the club 6. If the golf swing is correct none of the indicators 20, 30, 40 or 60 will be set into vibrating motion.

In practice, when the ball is resting on the grass, the indicators 50 shown in FIG. 3 are used for both the first and the second type of indicators. That is, as many as six of the indicators 50 are used on the device 9 at one time. Indicators 50 are constructed similarly to the indicators 30; and therefore, the components are marked with primed numbers of the corresponding parts of the indicator 30.

It is claimed:

1. A golf training device adapted to support a golf ball comprising:

(a) a base having a cavity formed therein, and at least one plate formed of ferromagnetic material being disposed within the cavity; said plate being recessed below the top surface of said base; and (b) a plurality of indicators, means utilizing magnetic forces for detachably mounting each indicator upon the upper surface of the plate in any one of an infinite variety of positions, each indicator having a vibratory member connected to the mounting means, the indicators being positioned on the plate proximate a substantial portion of an arc described by the head of a golf club at points before, during, and after the club contacts the ball, so that when a true swing is imparted to the head of the club, none of the indicators is set into vibratory motion; the mounting means simply moving with the head when the indicator is hit.

2. A golf training device according to claim 1 wherein the vibratory member is further characterized as being formed of a springy material that is set into vibratory motion by a slight brush of the golf club; the vibratory motion being of sufficient amplitude and duration that it could be easily detected visually.

3. A golf training device according to claim 1 wherein the mounting means further comprises a vertical column and means for adjusting the overall height of each indicator, the adjusting means including the vertical column having internal threads which are threadedly engageable with the vibratory member.

4. A golf training device adapted to support a golf ball comprising a base plate made of a material that can be subjected to magnetic forces; indicators which are held to the base plate by these magnetic forces, each of said indicators having a vibratory element which can be set into vibratory motion of sufficient amplitude and duration to signal the user visually that his club has come into contact with the indicator even while the remainder of the indicator remains fixed in position, the indicators being positioned on said base plate proximate a substantial portion of an arc described by the head of the golf club at points before, during and after the club contacts the ball, so that the user can tell what part of his swing needs improvement.

5. A golf training device comprising a structure of ferromagnetic material and a plurality of indicators held on the structure by magnetic forces, the indicators outlining the correct path of the golf club before, during and after ball contact, each indicator being held at any one of a wide variety of positions which are determinable by the user, each indicator being capable of signalling it has been struck while part of the indicator remains fixed in position.

* * * * *